US011152737B2

(12) United States Patent
Shimizu et al.

(10) Patent No.: US 11,152,737 B2
(45) Date of Patent: Oct. 19, 2021

(54) CONNECTOR AND WIRE HARNESS

(71) Applicant: Yazaki Corporation, Tokyo (JP)

(72) Inventors: Tomohiko Shimizu, Makinohara (JP); Tadashi Hasegawa, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/880,301

(22) Filed: May 21, 2020

(65) Prior Publication Data

US 2020/0373704 A1 Nov. 26, 2020

(30) Foreign Application Priority Data

May 24, 2019 (JP) ..... JP2019-097970

(51) Int. Cl.
*H01R 13/516* (2006.01)
*H01R 13/506* (2006.01)

(52) U.S. Cl.
CPC ..... *H01R 13/516* (2013.01); *H01R 13/506* (2013.01)

(58) Field of Classification Search
CPC ..... H01R 13/516; H01R 13/506
USPC ..... 439/626
See application file for complete search history.

(56) References Cited

U.S. PATENT DOCUMENTS 5,042,114 A * 8/1991 Parrish ..... F16L 3/233 24/16 PB
5,354,021 A * 10/1994 Farrell ..... F16L 3/233 24/16 PB
2010/0144193 A1* 6/2010 Omori ..... H01R 9/03 439/507
2012/0292460 A1* 11/2012 Hsu ..... H02G 7/053 248/70
2014/0131528 A1* 5/2014 Blakeley ..... H02G 3/32 248/74.2
2015/0323101 A1* 11/2015 Hobson ..... F16L 3/13 248/67.5
2016/0027553 A1* 1/2016 Murao ..... H01B 7/0045 174/72 A
2020/0373704 A1* 11/2020 Shimizu ..... H01R 13/516
2020/0388948 A1* 12/2020 Shimizu ..... H01R 13/4364

FOREIGN PATENT DOCUMENTS

CN 105122555 A 12/2015
JP 2009-170289 A 7/2009

* cited by examiner

*Primary Examiner* — Alexander Gilman
(74) *Attorney, Agent, or Firm* — Sughrue Mion, PLLC

(57) ABSTRACT

A connector which is held on an outer peripheral surface of a wire harness having a connector housing which includes an outer peripheral wall on which a tape is to be peripherally wound, and an outermost surface of the outer peripheral wall of the connector housing is provided with: a plurality of planar outer surfaces, ridge line portions, the ridge line portion is provided with a corner-removed chamfered portion and a non-chamfered portion, and the non-chamfered portion is engaged with a side edge of a tape wound around the outer surfaces so as to be used as a position displacement regulation projection configured to regulate an axial position displacement of the connector housing with respect to the tape.

3 Claims, 9 Drawing Sheets

CONNECTOR AND WIRE HARNESS

CROSS REFERENCE TO RELATED APPLICATIONS

This application is based on and claims priority from Japanese patent application No. 2019-097970 filed on May 24, 2019, the entire contents of which are incorporated herein by reference.

BACKGROUND OF THE INVENTION

1. Technical Field

The present invention relates to a connector which is fixed to a wire harness in a state of being held on an outer peripheral surface of the wire harness by winding a tape, and a wire harness including the connector.

2. Background Art

In the related art, as shown in FIG. 9, a connector 100 is fixed to a wire harness W by holding the connector 100 on an outer peripheral surface of the wire harness W and winding a tape T in that state (with reference to Patent Document 1). An example of this type of connector includes a joint connector used for a purpose of short-circuiting wire-side terminals on ends of electric wires branched from the wire harness W.

The connector 100 shown in FIG. 9 is also a joint connector, and a joint terminal (not shown) is accommodated inside a connector housing 100A. In the connector 100, protrusions such as a rib 101 and a width increasing portion 102 are provided on outer surfaces of end portions of the connector housing 100A, and a position of the connector 100 is not displaced due to these protrusions being caught with respect to the tape T wound between these protrusions.

PRIOR ART DOCUMENTS

Patent Documents

[Patent Document 1] JP-A-2009-170289

SUMMARY

However, the rib 101 and the width increasing portion 102 are protrusions on an external surface of the connector 100. Therefore, an outermost shape of the connector 100 may increase, and the weight may also increase. Further, when the connector 100 is handled, an external object is likely to hit these protrusions, and a risk of breakage of the connector is increased.

The present invention has been made in view of the above circumstances, and an object of the present invention is to provide a connector capable of regulating a position displacement with respect to a wound tape while eliminating a protrusion on an external surface of a connector housing as much as possible, thus avoiding breakage caused by catching during handling without causing an increase in outermost shape and an increase in weight, and a wire harness including the connector.

In order to achieve the above object, the connector and wire harness according to the present invention are characterized by the following (1) to (3).

(1) A connector which is held on an outer peripheral surface of a wire harness in a posture that an axial direction of the connector is directed in an extending direction of the wire harness, and which is fixed to the wire harness in this state by winding a tape, the connector comprising:

a connector housing, wherein the connector housing includes an outer peripheral wall on which a tape is to be peripherally wound, and an outermost surface of the outer peripheral wall of the connector housing is provided with a plurality of planar outer surfaces which are respectively planar surfaces along the axial direction and have such a relationship that peripherally adjacent planar outer surfaces intersect each other; and ridge line portions along the axial direction in which the peripherally adjacent planar outer surfaces intersect each other, wherein the ridge line portion is provided with a corner-removed chamfered portion which has a smaller peripheral width than the planar outer surfaces on both sides thereof, and a non-chamfered portion which is located at a rear end portion of the chamfered portion in a ridge line direction, and wherein the non-chamfered portion protrudes outward from a surface of the chamfered portion, is on an inner side of or on extending surfaces of the planar outer surfaces on both sides of the chamfered portion, and is engaged with a side edge of a tape wound around the outer surfaces so as to be used as a position displacement regulation projection configured to regulate an axial position displacement of the connector housing with respect to the tape.

(2) The connector according to above (1), wherein the connector is a joint connector in which a joint terminal configured to contact a plurality of mating terminals so as to short-circuit the mating terminals is accommodated inside the connector housing.

(3) A wire harness comprising:

a wire harness body formed of a plurality of electric wires; and a joint connector configured to electrically short-circuit wire-side terminals which are a plurality of mating terminals respectively provided at ends of a plurality of electric wires included in the wire harness body, wherein the joint connector is the connector according to above (2), and wherein the connector housing of the joint connector is held on an outer peripheral surface of the wire harness body in a posture that an axial direction of the joint connector is directed in an extending direction of the wire harness body, and is fixed to the wire harness body by winding the tape at a position of the chamfered portion on the outer peripheral wall of the connector housing.

According to the connector having a configuration described in the above (1), the corner-removed chamfered portion and the non-chamfered portion which is left without being chamfered are formed on the ridge line portion along the axial direction in which the outer surfaces of the connector housing intersect. Further, the non-chamfered portion located at the rear end of the chamfered portion in the ridge line direction is defined as the position displacement regulation projection of the connector housing with respect to the wound tape. The position displacement regulation projection is implemented by the non-chamfered portion, and protrudes outward from the surface of the chamfered portion. Therefore, it is possible to prevent position displacement of the connector housing with respect to the tape wound at the position of the chamfered portion. The position displacement regulation projection implemented by the non-chamfered portion is on the inner side of or on the extending surfaces of the planar outer surfaces on both sides of the chamfered portion. That is, the position displacement regulation projection does not protrude outside of the planar outer surface. Therefore, a protrusion protruding from an external surface of the connector housing can be eliminated as much as possible, thus, an increase in outermost shape and an increase in weight can be avoided, and moreover, breakage caused catching during handling can be prevented.

According to the connector having a configuration described in the above (2), when the joint connector is fixed to the outer peripheral surface of the wire harness by winding a tape, the position displacement with respect to the tape can be prevented. Moreover, since the protrusion protruding from the outer surface of the connector housing is eliminated as much as possible, an increase in outermost shape and an increase in weight of the connector can be avoided, and further, breakage during handling can be prevented.

According to the wire harness having a configuration described in the above (3), the joint connector used for short-circuiting the branch lines from the wire harness body can be fixed to the outer peripheral surface of the wire harness body by winding a tape, and the position displacement therebetween can be prevented. Further, since the protrusion protruding from the outer surface of the connector housing is eliminated as much as possible, an increase in outermost shape and an increase in weight of the connector can be avoided, and further, breakage during handling can be prevented.

According to the present invention, the position displacement with respect to the wound tape can be regulated while eliminating the protrusion protruding from the external surface of the connector housing as much as possible, therefore, an increase in outermost shape (outer dimension) and an increase in weight can be avoided, and moreover, the breakage caused by catching during handling can be avoided.

The present invention has been briefly described above. Further, details of the present invention will be clarified by reading a mode (hereinafter, referred to as "embodiment") for carrying out the invention to be described below with reference to accompanying drawings.

BRIEF DESCRIPTION OF THE DRAWINGS

FIG. 8A shows a relationship between the tape and a position displacement regulation projection when the joint connector is fixed to the wire harness body in a posture that a bracket side faces an outer peripheral surface of the wire harness body by winding a tape, FIGS. 8B and 8C show relationships between the tape and the position displacement regulation projection when the joint connector is fixed to the wire harness body in a posture that an opposite side of the bracket side faces the outer peripheral surface of the wire harness body by winding a tape, and FIG. 8C shows a state in which a diameter of the wire harness body is slightly larger than a width of the joint connector.

DETAILED DESCRIPTION OF EMBODIMENTS

A specific embodiment of the present invention will be described below with reference to the drawings.

A connector according to the present embodiment is a joint connector in which joint terminals that contact a plurality of mating terminals to short-circuit the mating terminals are accommodated inside a connector housing. In a use state, the joint connector is fixed to a wire harness by winding a tape.

Figure 1:
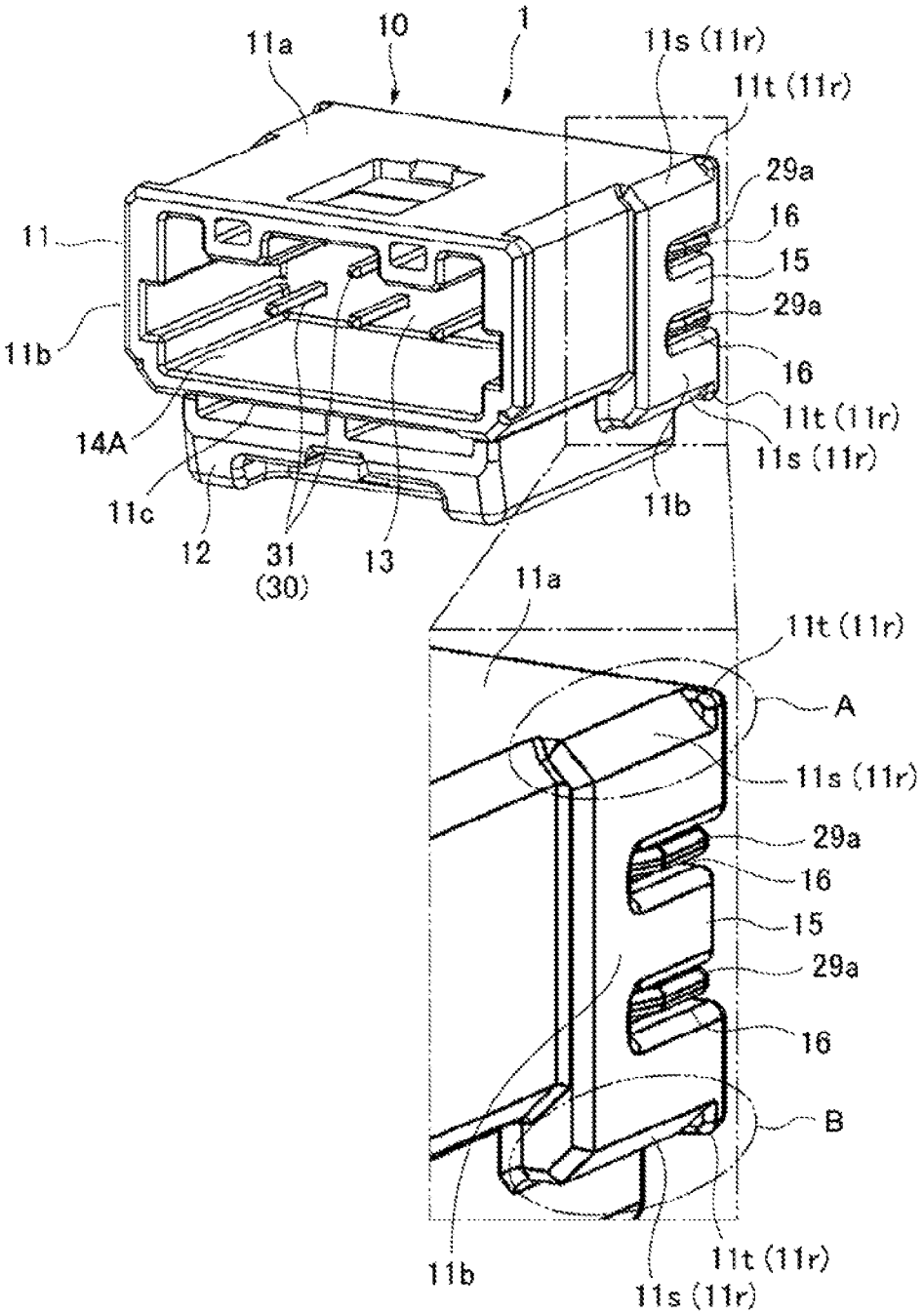
FIG. 1 shows a perspective view of a joint connector according to an embodiment of the present invention as viewed from front, and a partially enlarged view thereof.
Figure 2:
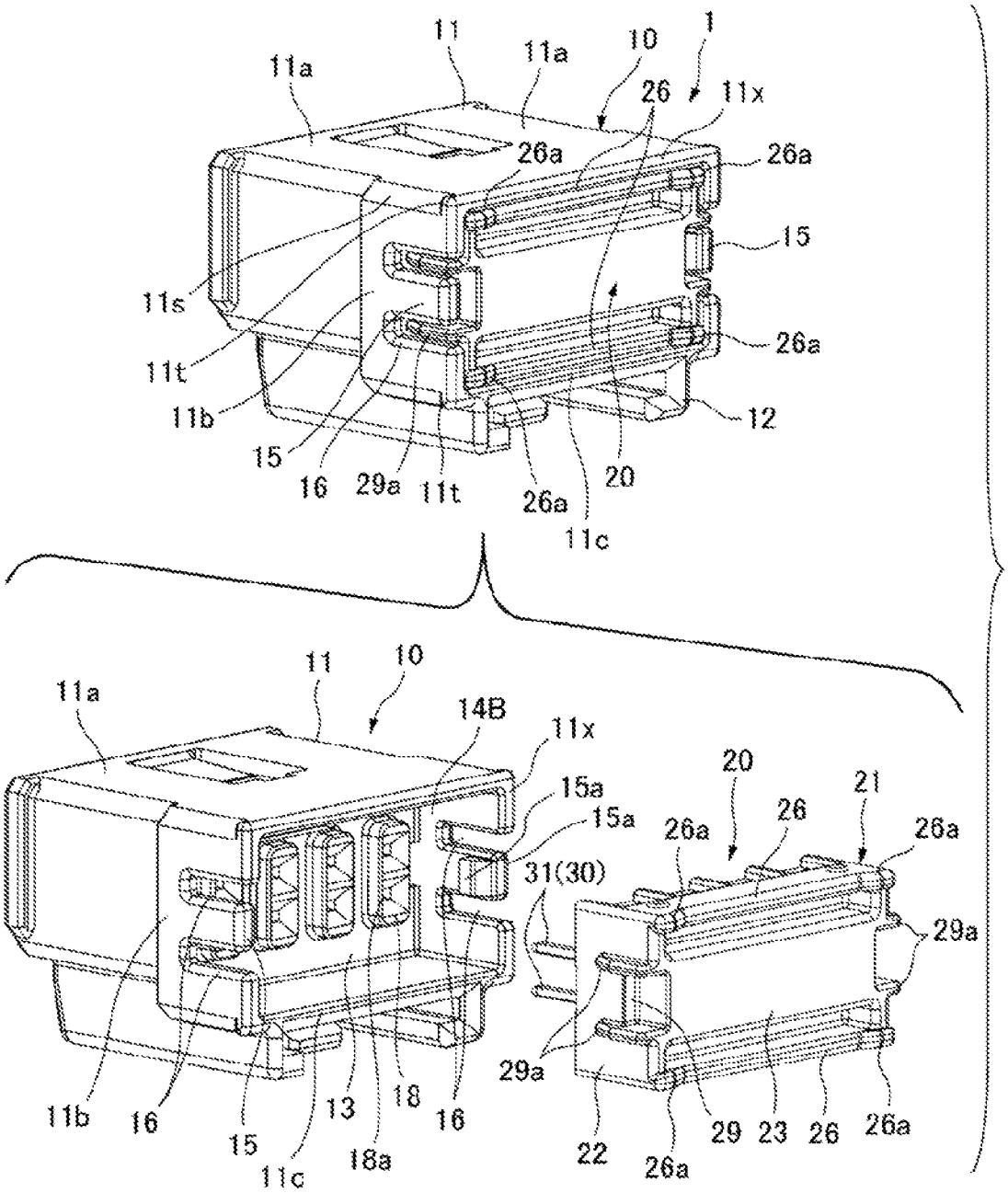
FIG. 2 shows a perspective view of the joint connector as viewed from behind, and an exploded perspective view thereof.
Figure 3:
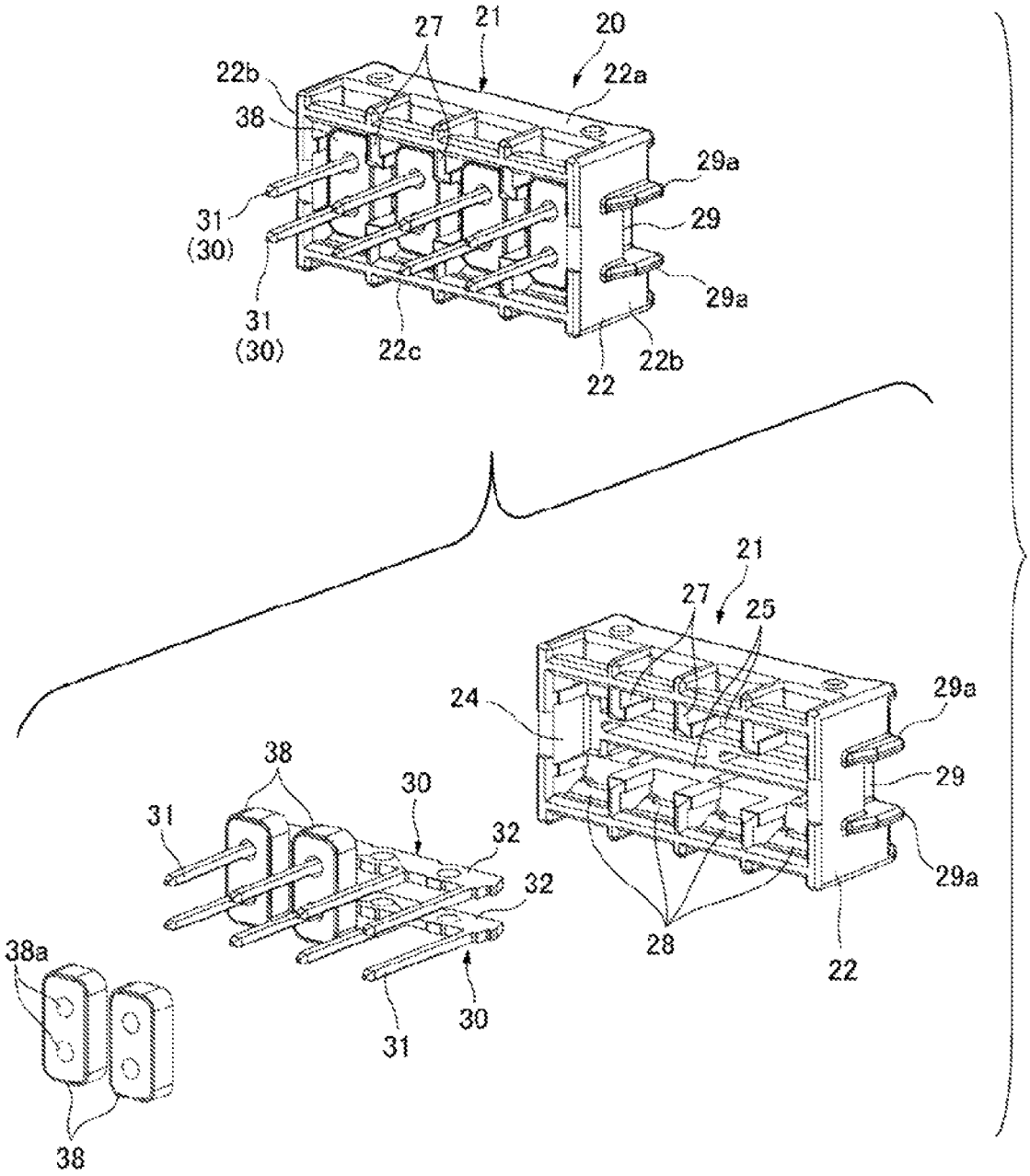
FIG. 3 shows a perspective view of a joint terminal unit, which is a component of the joint connector, as viewed from front, and an exploded perspective view thereof.
Figure 4:
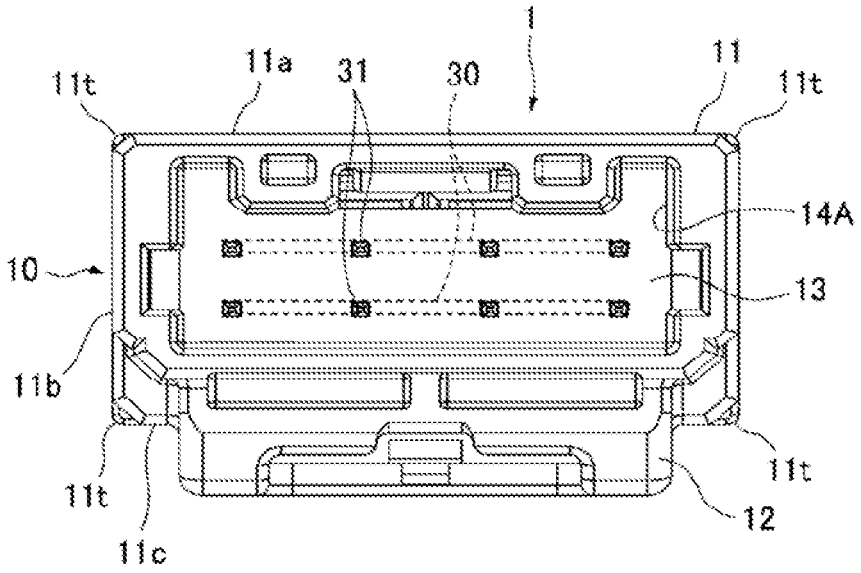
FIG. 4 is a front view of the joint connector.
Figure 5:
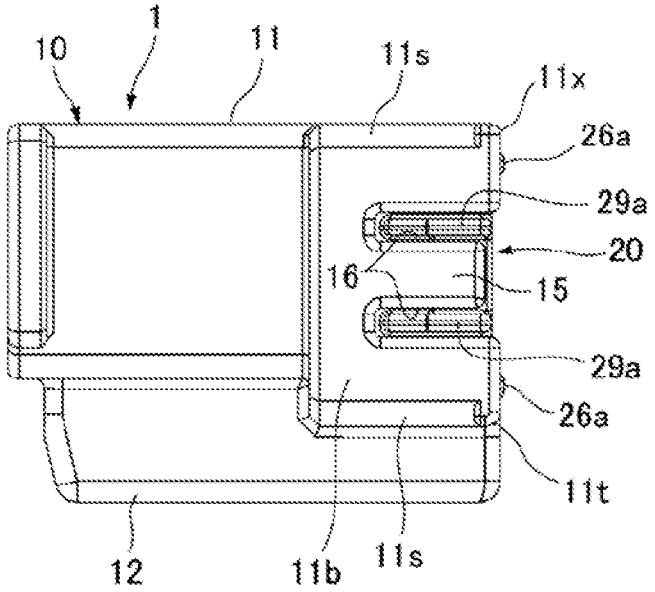
FIG. 5 is a side view of the joint connector.

FIG. 1 shows a perspective view of the joint connector according to the present embodiment as viewed from front, and a partially enlarged view thereof, FIG. 2 shows a perspective view of the joint connector as viewed from behind, and an exploded perspective view thereof, and FIG. 3 shows a perspective view of a joint terminal unit, which is a component of the joint connector, as viewed from front, and an exploded perspective view thereof. Further, FIG. 4 is a front view of the joint connector, and FIG. 5 is a side view of the joint connector. Furthermore, FIG. 6 is a perspective view, as viewed from front, showing a state in which the joint connector is fixed to a wire harness body (trunk line) by winding a tape, and FIG. 7 is a schematic configuration diagram of a main part of the wire harness on which the joint connector is fixed by winding a tape.

Figure 6:
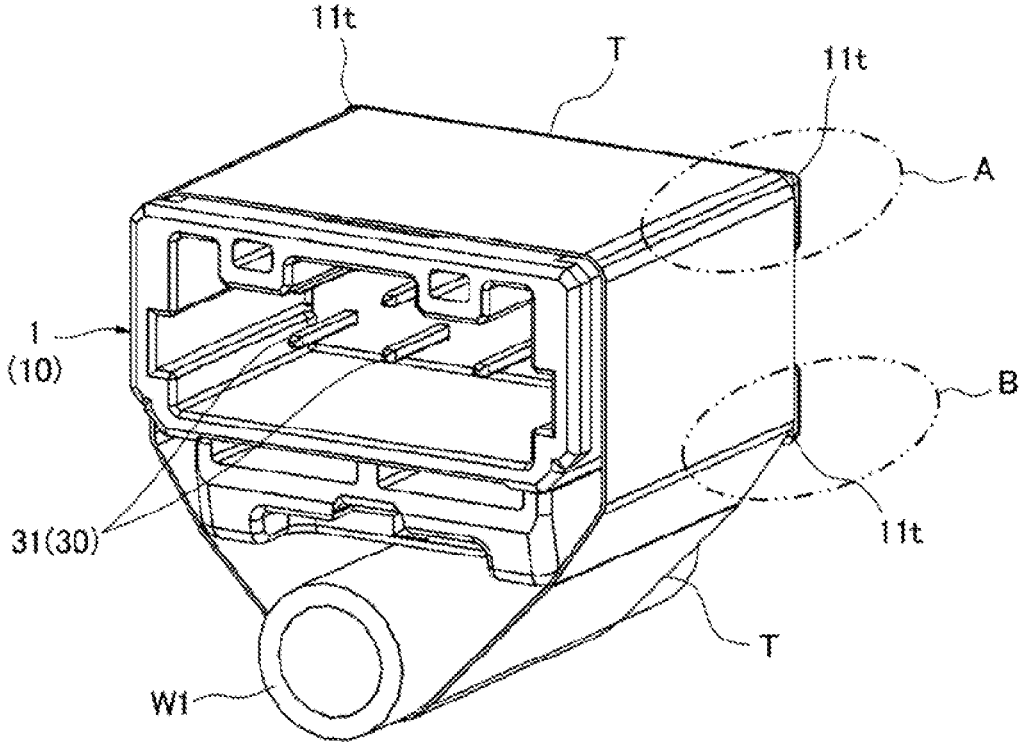
FIG. 6 is a perspective view, as viewed from front, showing a state in which the joint connector is fixed to a wire harness body (trunk line) by winding a tape.
Figure 7:
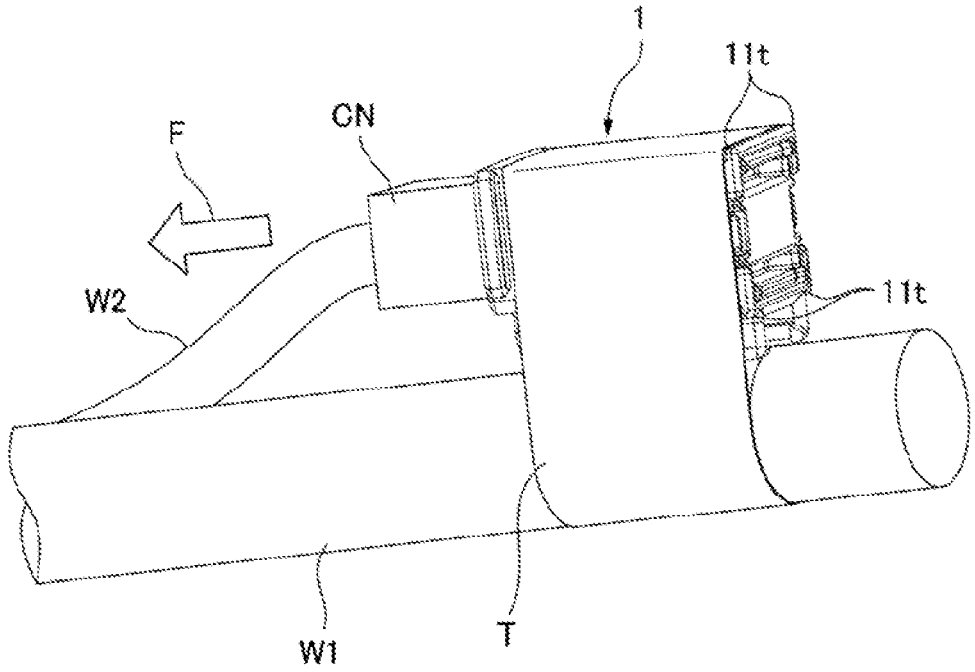
FIG. 7 is a schematic configuration diagram of a main part of a wire harness on which the joint connector is fixed by winding a tape.

As shown in FIGS. 6 and 7, a joint connector 1 is held on an outer peripheral surface of a trunk line (wire harness body) W1 of a wire harness in a posture that an axial direction of the joint connector 1 is directed in an extending direction of the trunk line W1 of the wire harness, and is fixed to the trunk line W1 of the wire harness in this state by winding a tape. Here, the axial direction refers to a fitting direction of a mating connector CN (with reference to FIG. 7), that is, an extending direction (longitudinal direction) of an electrical contact portion (tab or pin) 31 of a joint terminal 30.

As shown in FIG. 2, the joint connector 1 includes a connector housing (also referred to as "outer housing") 10 which is an integral molded product of resin, and a joint terminal unit 20 accommodated and held inside the connector housing 10. As shown in FIG. 3, in the joint terminal unit 20, two joint terminals 30 are assembled to a terminal holder (also referred to as "inner housing") 21 which is an integral molded product of resin, and ferrites 38 are disposed at the joint terminal 30.

As shown in FIG. 2, the joint terminal unit 20 is fitted and assembled to an inside of the connector housing 10 from the rear of the connector housing 10. As shown in FIG. 1, the connector housing 10 has a rectangular cylindrical outer peripheral wall 11 surrounding an internal space into which the joint terminal unit 20 is inserted. A bracket 12 for fixing the connector 10 to a stay or the like of a vehicle body is provided on a lower surface of the outer peripheral wall 11. As shown in FIG. 1 and the exploded view of FIG. 2, the internal space surrounded by the outer peripheral wall 11 is partitioned into a front space 14A and a rear space 14B by a partition wall 13.

The partition wall 13 is provided as a separation wall perpendicular to the axial direction. The front space 14A located on a front side of the partition wall 13 is configured as a fitting hole (hereinafter also referred to as "mating connector fitting hole 14A") into which the mating connector CN is to be fitted. Further, the rear space 14B located on a rear side of the partition wall 13 is configured as a fitting hole (hereinafter also referred to as "joint terminal unit fitting hole 14B") into which the terminal holder 21 of the joint terminal unit 20 is to be fitted.

When the terminal holder 21 of the joint terminal unit 20 is fitted into the rear space 14B, the pin-shaped electrical contact portions 31 of the joint terminal 30 protrude into the front space 14A passing through holes 18*a* provided in the partition wall 13. Further, when the mating connector CN is fitted into the front space 14A from the front, terminals (also referred to as mating terminals or wire-side terminals) of the mating connector CN is brought into contact with the electrical contact portions 31 of the joint terminals 30. As shown in the exploded view of FIG. 2, the through hole 18*a* in the partition wall 13 is provided in a terminal receiving portion 18 provided on the rear surface of the partition wall 13. The ferrites 38 of the joint terminal unit 20 are pressed against the terminal receiving portions 18.

As shown in FIG. 3, the terminal holder 21, which is a main component of the joint terminal unit 20, is formed in a rectangular shape as viewed from the front, which is to be fitted into the rear space (joint terminal unit fitting hole) 14B in the connector housing 10. The terminal holder 21 has a peripheral wall 22 formed in an outer peripheral shape matching an inner peripheral shape of the joint terminal unit fitting hole 14B, and a rear wall 23 (with reference to FIG. 2) located at an inner peripheral side rear end portion of the peripheral wall 22. Joint terminal holding grooves 25 are provided on a front surface of the rear wall 23. Ferrite holding portions 28 are provided in an internal space 24 of the terminal holder 21 on the front side of the rear wall 23, and the ferrite holding portions 28 are used to separate and hold the ferrites 38 and are obtained by partitioning by partition ribs 27. Further, the peripheral wall 22 of the terminal holder 21 includes an upper wall 22*a*, left and right walls 22*b*, and a lower wall 22*c*, and each of the left and right walls 22*b* is provided with a step-shaped locking portion 29 and a pair of guide ribs 29*a* located above and below the locking portion 29. The pair of guide ribs 29*a* are formed parallel to the axial direction.

As shown in FIG. 3, the joint terminal 30 is a bus bar including a plurality of pin-shaped electrical contact portions 31 having a shape capable of being brought into contact with respective mating terminals (terminals of the mating connector) and arranged in a direction substantially perpendicular to the axial direction of the joint connector 1; and a rear end side short-circuiting portion 32 extending in an arrangement direction of the electrical contact portions 31 and connecting rear end portions of the respective electrical contact portions 31. Two joint terminals 30 of the same configuration are assembled to the terminal holder 21, with the electrical contact portions 31 facing forward and being parallel to each other, in a state in which the short-circuiting portions 32 at the rear ends are accommodated in the upper and lower joint terminal holding grooves 25 of the terminal holder 21, respectively. Further, the joint terminals 30 are respectively held by the terminal holder 21 in a state in which two electrical contact portions 31 arranged above and below in two joint terminals 30 pass through two through holes 38*a* of the ferrite 38.

When the connector 1 is used, as shown in FIG. 6, a tape T is wound around the outer peripheral wall 11 of the connector housing 10 along a peripheral direction thereof. Therefore, as shown in FIGS. 1, 2, 4, and 5, an outermost surface of the outer peripheral wall 11 of the connector housing 10 has the following structure.

First, the outermost surface of the outer peripheral wall 11 is provided with a plurality of planar outer surfaces (an upper surface 11*a*, left and right surfaces 11*b*, and a lower surface 11*c*) which are planar surfaces along the axial direction and have such a relationship that peripherally adjacent planar outer surfaces intersect each other. The outermost surface of the outer peripheral wall 11 is provided with ridge line portions 11*r* along the axial directions in which the peripherally adjacent planar outer surfaces (the upper surface 11*a*, the left and right surfaces 11*b*, and the lower surface 11*c*) intersect each other. Further, the ridge line portion 11*r* is provided with a corner-removed chamfered portion 11*s* which has a smaller peripheral width than the planar outer surfaces (the upper surface 11*a*, the left and right surfaces 11*b*, and the lower surface 11*c*) on both sides thereof, and a non-chamfered portion 11*t* which is located at a rear end of the chamfered portion 11*s* in a ridge line direction. The non-chamfered portion 11*t* is a portion where a corner is left without being chamfered. In FIG. 1, portions surrounded by two-dot chain lines A and B correspond to the ridge line portion 11*r*.

The non-chamfered portion 11*t* protrudes outward from a surface of the chamfered portion 11*s* and is on an inner side of or on extending surfaces of the planar outer surfaces (the upper surface 11*a*, the left and right surface 11*b*, and the lower surface 11*c*) on both sides of the chamfered portion 11*s* (on the extending surface in this example). As shown in FIG. 6, the non-chamfered portion 11*t* is a portion that regulates an axial position displacement of the connector housing 10 with respect to the tape T by engaging with a side edge of the tape T wound around the outer surfaces (the upper surface 11*a*, the left and right surfaces 11*b*, and the lower surface 11*c*) at a position of the chamfered portions 11*s* when the tape is wound, that is, a position displacement regulation projection 11*t*. Hereinafter, the non-chamfered portion is referred to as the position displacement regulation projection 11*t*.

Locking arms 15 are respectively provided on the left and right walls (the left and right walls on which the left and right surfaces 11*b* are formed) among the peripheral wall (the outer peripheral wall 11 of the connector housing 10) of the rear space (joint terminal unit fitting hole) 14B of the connector housing 10 into which the terminal holder 21 of the joint terminal unit 20 is to be fitted. The locking arms 15 of the left and right walls lock the terminal holder 21 of the joint terminal unit 20 fitted in the joint terminal unit fitting hole 14B. Guide grooves 16 are provided above and below each locking arm 15. The guide groove 16 is a groove for guiding the guide rib 29*a* of the terminal holder 21 when the joint terminal unit 20 is fitted into the connector housing 10.

The pair of parallel guide grooves 16 are formed from a rear end edge 11*x* of the outer peripheral wall 11 of the connector housing 10 toward the front, and thus the locking arm 15 has a front end connected to the outer peripheral wall 11, extends rearward in a cantilever manner, and is flexibly deformable outward. A locking beak 15*a* having a trapezoidal cross section, for example, is formed on an inner surface on a free end (rear end) side of the locking arm 15. Then, when the terminal holder 21 is fitted into the joint terminal unit fitting hole 14B from behind, corresponding to a process of the fitting operation, the locking arm 15 is flexibly deformed outward due to interference with the terminal holder 21, and is resumed from the flexible deformation at a stage where the locking beak 15*a* rides over the locking portion 29 of the terminal holder 21, and the locking beak 15*a* is kept in a position behind the locking portion 29. Therefore, the locking beaks 15*a* are engaged with the locking portions 29, and the locking arms 15 lock the terminal holder 21.

When being engaged with the locking portion 29 of the terminal holder 21, the locking beak 15*a* of the locking arm 15 is positioned behind the locking portion 29, so that the terminal holder 21 is position-regulated so as not move rearward. Moreover, in this state, the terminal holder 21 is position-regulated in a forward direction by, for example, abutting against the partition wall 13 inside the connector housing 10. Therefore, the terminal holder 21 is position-regulated so as not to move forward or rearward.

In this state, for example, when the joint connector 1 falls from the rear end to a floor surface and a large external force is applied to a rear end edge of the locking arm 15 or the rear end edge 11*x* of the connector housing 10, a strong impact force acts on locking portions between the locking beak 15*a* and the locking portion 29, and this locking portion may be damaged.

Therefore, in the joint connector 1, as a countermeasure, first, as shown in FIG. 5, the rear end edge (free end edge) of the locking arm 15 is retracted forward (a front side) than the rear end edge 11*x* of the connector housing 10. As shown in FIG. 2, two upper and lower rod-shaped ribs 26 each extending in a left-right direction are provided on a rear end surface of the terminal holder 21 (a rear end surface of the rear wall 23), and projection portions 26*a* protruding rearward are provided at both ends of each rib 26. The four upper, lower, left and right projection portions 26*a* are located in a vicinity of the locking arms 15, and protrude rearward from the rear end edge 11*x* of the connector housing 10, as shown in FIG. 5, in a state in which the terminal holder 21 is assembled to the connector housing 10. Therefore, if the connector 1 falls from a rear end edge 11*x* side of the connector housing 10 and collides with the floor surface, the four projection portions 26*a* of the terminal holders 21 are first brought into contact with the floor surface. Further, in a state in which the joint terminal unit 20 is appropriately assembled to the connector housing 10, a rear end edge of the joint terminal unit 20 is entirely hidden inside the rear end edge 11*x* of the connector housing 10 except for the projection portions 26*a*. As described above, the joint terminal unit 20 is entirely hidden in the connector housing 10 except for the four projection portions 26*a*, so that it can be easily visually determined that the joint terminal unit 20 is not in a halfway fitted state with respect to the connector housing 10.

When the joint connector 1 is to be assembled, first, the joint terminals 30 and the ferrites 38 are assembled to the terminal holder 21 to form the joint terminal unit 20. Next, the joint terminal unit 20 is fitted into the joint terminal unit fitting hole 14B from a rear side of the connector housing 10. Then, for example, a front end of the terminal holder 21 is abutted on a rear end of the partition wall 13 of the connector housing 10, and the joint terminal unit 20 is position-regulated in the forward direction. At the same time, the locking arms 15 are engaged with and locked in the locking portions 29 of the terminal holder 21, and assembly of the joint connector 1 is completed. At this time, the guide ribs 29*a* of the terminal holder 21 are guided in the guide grooves 16 on the connector housing 10 side. In this state, the pin-shaped electrical contact portions 31 of the joint terminals 30 pass through the partition wall 13 of the connector housing 10 and protrude into the front space 14A. Further, as described above, the four projection portions 26*a* provided on the rear wall 23 of the terminal holder 21 protrude rearward from the rear end edge 11*x* of the connector housing 10 (with reference to FIG. 5).

Therefore, in a case where the joint connector 1 is handled independently, when the joint connector 1 is dropped from the rear end side to the floor surface, a collision force first acts on the terminal holder 21 but not on the connector housing 10. Therefore, the collision force is transmitted to the connector housing 10 via abutting portions at a front end of the terminal holder 21, it is possible to prevent a strong impact from acting on the engagement portions between the locking arm 15 and the locking portion 29, and the breakage can be prevented.

Next, a case where the joint connector 1 is used will be described.

As shown in FIG. 7, when a plurality of electric wires in a branch line W2 branched from the wire harness body (trunk line) W1 formed of a plurality of electric wires are to be short-circuited one other, the joint connector 1 is used. In this case, the wire-side connector CN is attached to an end of the branch line W2 in advance. A wire-side terminal (mating terminal) attached to the end of each electric wire of the branch line W2 is accommodated in the wire-side connector CN. Next, the joint connector 1 is held on the outer peripheral surface of the wire harness body W1 in a posture that the axial direction is directed in the extending direction of the wire harness body (trunk line) W1. The direction of the joint connector 1 is set such that the connector fitting hole on the front side faces the connector CN of the branch line W2. Then, as shown in FIG. 6, the tape T is wound around the joint connector 1 and the wire harness body W1, and the joint connector 1 is fixed to the wire harness body W1. At any timing, the wire-side connector CN is fitted into the connector fitting hole of the joint connector 1. Thus, it possible to obtain a wire harness in which a predetermined plurality of electric wires of the branch line W2 are short-circuited by the joint connector 1.

According to the joint connector 1, in a state in which the joint connector 1 is fixed by winding a tape, the position displacement of the joint connector 1 with respect to the tape T and the wire harness body W1 can be prevented by the position displacement regulation projections 11*t* provided on the outer peripheral wall 11 of the connector housing 10. That is, in the use state, an external force may act on the joint connector 1 in a direction indicated by an arrow F in FIG. 7, but when such an external force acts, even if the joint connector 1 attempts to move in the direction indicated by the arrow F, the position displacement regulation projections 11*t* of the joint connector 1 are caught on the side edge of the tape T as shown by two-dot chain line circles A and B in FIG. 6. Therefore, the position displacement of the joint connector 1 can be prevented.

In particular, in the joint connector 1, the ridge line portion 11*r* along the axial direction in which the outer surfaces (the upper surface 11*a*, the left and right surfaces 11*b*, and the lower surface 11*c*) of the connector housing 10 intersect is provided with the corner-removed chamfered portion 11*s* and the non-chamfered portion 11*t* which is left without being chamfered. Further, the non-chamfered portion 11*t* located at the rear end of the chamfered portion 11*s* in the ridge line direction is defined as the position displacement regulation projection of the connector housing 10 with respect to the wound tape T. The position displacement regulation projection 11*t* is implemented by the non-chamfered portion and protrudes outward from the surface of the chamfered portion 11*s*. Therefore, the position displacement of the connector housing 10 with respect to the tape T wound at the position of the chamfered portion 11*s* can be prevented. The position displacement regulation projection 11*t* implemented by the non-chamfered portion is on the inner side of or on the extending surfaces of the planar outer surfaces (the upper surface 11*a*, the left and right surfaces 11*b*, and the lower surface 11*c*) on both sides of the chamfered portion 11*s*. That is, the position displacement regulation projection 11*t* does not protrude outside the planar outer surfaces (the upper surface 11*a*, the left and right surfaces 11*b*, and the lower surface 11*c*) at least. Therefore, the protrusion protruding from an external surface of the connector housing 10 can be eliminated as much as possible, thus, an increase in outermost shape of the joint connector 1 and an increase in weight can be avoided, and moreover, damage caused catching during handling can be prevented.

Figure 8A:
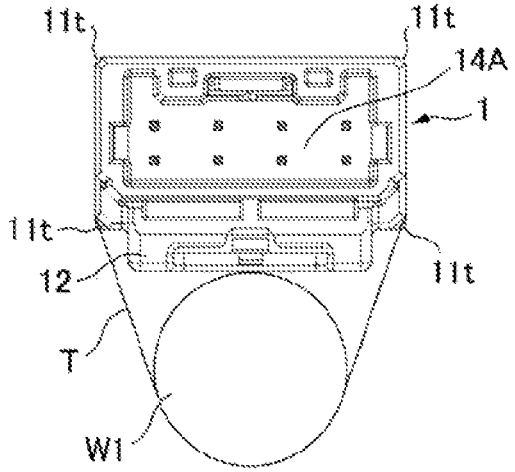
FIGS. 8A to 8C are front views showing a relationship of a wire harness body (trunk line), a joint connector, and a tape wound therearound.
Figure 8B:
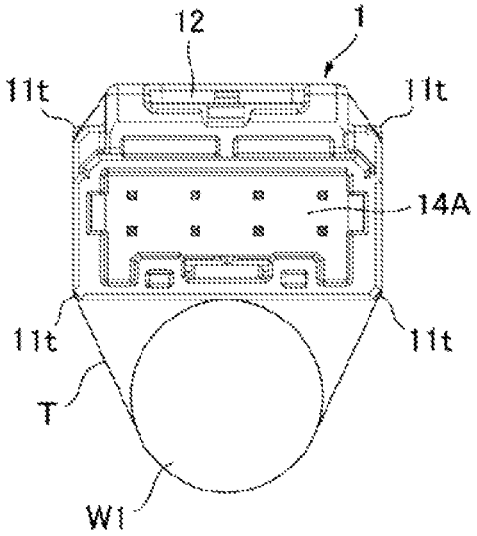
Figure 8C:
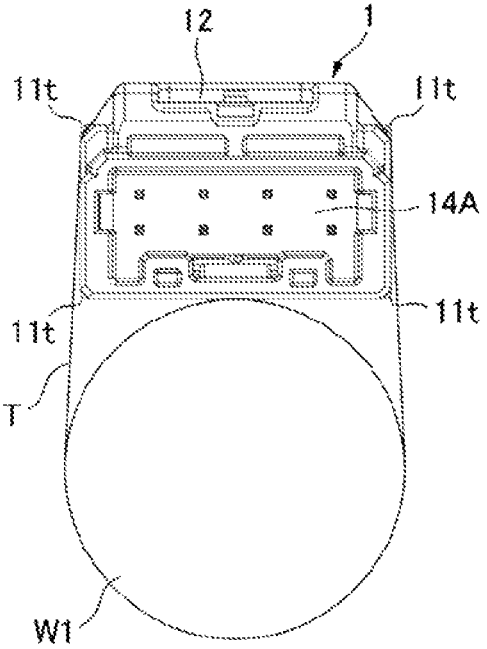
Figure 9:
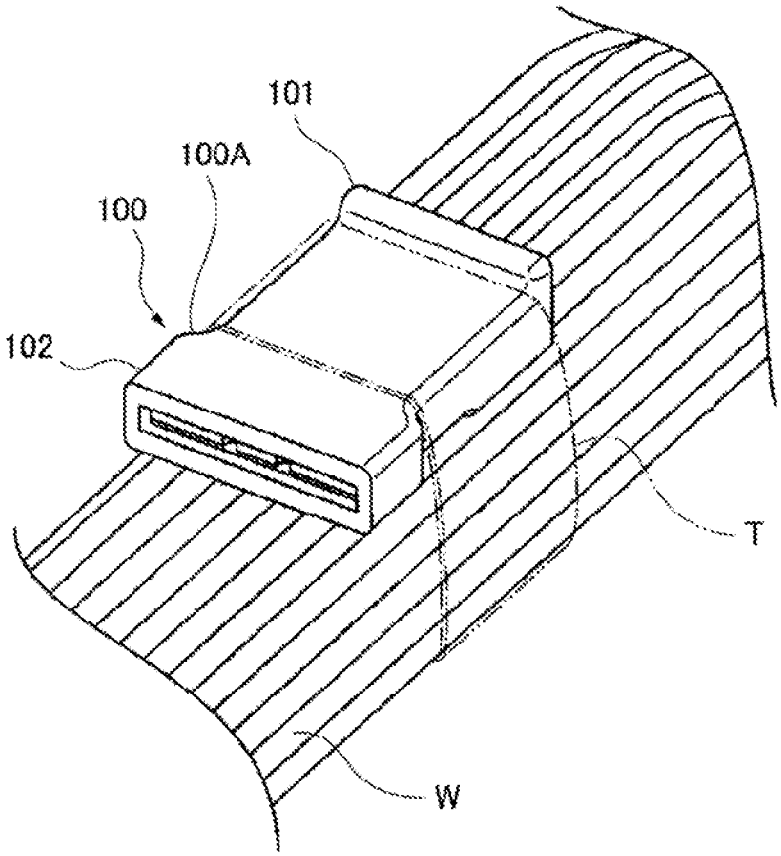
FIG. 9 is an explanatory diagram of an example in the related art.

FIGS. 8A to 8C are front views showing a relationship between the wire harness body W1, the joint connector 1, and the tape T wound therearound. FIG. 8A shows a relationship between the tape T and the position displacement regulation projection 11*t* when the joint connector 1 is fixed to the wire harness body W1 in a posture that a bracket 12 side of the joint connector 1 faces the outer peripheral surface of the wire harness body W1 by winding a tape. In this case, a diameter of the wire harness body W1 is smaller than a width of the joint connector 1. Therefore, four position displacement regulation projections 11*t* provided in the four ridge line portions are caught on the wound tape T, respectively.

FIGS. 8B and 8C show relationships between the tape T and the position displacement regulation projection 11*t* when the joint connector 1 is fixed to the wire harness body W1 in a posture that an opposite side of the bracket 12 side of the joint connector 1 faces the outer peripheral surface of the wire harness body W1 by winding a tape. FIG. 8B shows a case where the diameter of the wire harness body W1 is smaller than the width of the joint connector 1, and FIG. 8C shows a case where the diameter of the wire harness body W1 is larger than the width of the joint connector 1.

In the case of FIG. 8B, four position displacement regulation projections 11*t* provided on the four ridge line portions are caught on the wound tape T, respectively. In the case of FIG. 8C, two position displacement regulation projections 11*t* provided on two ridge line portions are caught on the wound tape T, respectively.

As described above, since at least two position displacement regulation projections 11*t* are caught on the wound tape T in either case, the position displacement of the joint connector 1 can be effectively prevented.

Here, features of the connector and the wire harness according to the embodiment of the present invention described above will be briefly summarized in the following [1] to [3].

[1] A connector which is held on an outer peripheral surface of a wire harness (W1) in a posture that an axial direction of the connector is directed in an extending direction of the wire harness (W1), and which is fixed to the wire harness (W1) in this state by winding a tape, includes a connector housing (10), the connector housing (10) includes an outer peripheral wall (11) on which a tape is to be peripherally wound, and an outermost surface of the outer peripheral wall (11) of the connector housing (10) is provided with: a plurality of planar outer surfaces (11*a*, 11*b*, 11*c*) which are respectively planar surfaces along the axial direction and have such a relationship that peripherally adjacent planar outer surfaces intersect each other; and ridge line portions (11*r*) along the axial direction in which the peripherally adjacent planar outer surfaces intersect each other, the ridge line portion (11*r*) is provided with a corner-removed chamfered portion (11*s*) which has a smaller peripheral width than the planar outer surfaces (11*a*, 11*b*, 11*c*) on both sides thereof, and a non-chamfered portion (11*t*) which is located at a rear end portion of the chamfered portion (11*s*) in a ridge line direction, and the non-chamfered portion (11*t*) protrudes outward from a surface of the chamfered portion (11*s*), is on an inner side of or on extending surfaces of the planar outer surfaces (11*a*, 11*b*, 11*c*) on both sides of the chamfered portion (11*s*), and is engaged with a side edge of a tape (T) wound around the outer surfaces (11*a*, 11*b*, 11*c*) so as to be used as a position displacement regulation projection (11*t*) configured to regulate an axial position displacement of the connector housing (10) with respect to the tape (T).

[2] The connector (1) described in the above [1] is a joint connector (1) in which a joint terminal (30) configured to contact a plurality of mating terminals so as to short-circuit the mating terminals is accommodated inside the connector housing (10).

[3] A wire harness includes: a wire harness body (W1) formed of a plurality of electric wires; and a joint connector (1) configured to electrically short-circuit wire-side terminals which are a plurality of mating terminals respectively provided at ends of a plurality of electric wires (W2) included in the wire harness body (W1), the joint connector (1) is the connector described in the above [2], and the connector housing (10) of the joint connector (1) is held on an outer peripheral surface of the wire harness body (W1) in a posture that an axial direction of the joint connector (1) is directed in an extending direction of the wire harness body (W1), and is fixed to the wire harness body (W1) by winding the tape (T) at a position of the chamfered portion (11*s*) on the outer peripheral wall (11) of the connector housing (10).

What is claimed is:

1. A connector which is held on an outer peripheral surface of a wire harness in a posture that an axial direction of the connector is directed in an extending direction of the wire harness, and which is fixed to the wire harness in this state by winding a tape, the connector comprising:

a connector housing, wherein the connector housing includes an outer peripheral wall on which a tape is to be peripherally wound, and an outermost surface of the outer peripheral wall of the connector housing is provided with a plurality of planar outer surfaces which are respectively planar surfaces along the axial direction and have such a relationship that peripherally adjacent planar outer surfaces intersect each other; and ridge line portions along the axial direction in which the peripherally adjacent planar outer surfaces intersect each other, wherein the ridge line portion is provided with a corner-removed chamfered portion which has a smaller peripheral width than the planar outer surfaces on both sides thereof, and a non-chamfered portion which is located at a rear end portion of the chamfered portion in a ridge line direction, and wherein the non-chamfered portion protrudes outward from a surface of the chamfered portion, is on an inner side of or on extending surfaces of the planar outer surfaces on both sides of the chamfered portion, and is engaged with a side edge of a tape wound around the outer surfaces so as to be used as a position displacement regulation projection configured to regulate an axial position displacement of the connector housing with respect to the tape.

2. The connector according to claim 1, wherein the connector is a joint connector in which a joint terminal configured to contact a plurality of mating terminals so as to short-circuit the mating terminals is accommodated inside the connector housing.

3. A wire harness comprising:

a wire harness body formed of a plurality of electric wires; and a joint connector configured to electrically short-circuit wire-side terminals which are a plurality of mating terminals respectively provided at ends of a plurality of electric wires included in the wire harness body, wherein the joint connector is the connector according to claim 2, and wherein the connector housing of the joint connector is held on an outer peripheral surface of the wire harness body in a posture that an axial direction of the joint connector is directed in an extending direction of the wire harness body, and is fixed to the wire harness body by winding the tape at a position of the chamfered portion on the outer peripheral wall of the connector housing.

* * * * *